US011674712B2

(12) United States Patent
Huang et al.

(10) Patent No.: US 11,674,712 B2
(45) Date of Patent: Jun. 13, 2023

(54) OUTDOOR AIR CONTROLS FOR PACKAGED HVAC SYSTEMS

(71) Applicant: Allied Air Enterprises LLC, Richardson, TX (US)

(72) Inventors: WenYen Huang, Cayce, SC (US); Mitchell Evan Lockhart, Columbia, SC (US); Jeffrey Paul Gedcke, Gilbert, SC (US); Anthony Edward Spiggle, Columbia, SC (US)

(73) Assignee: Allied Air Enterprises LLC, Richardson, TX (US)

( * ) Notice: Subject to any disclaimer, the term of this patent is extended or adjusted under 35 U.S.C. 154(b) by 734 days.

(21) Appl. No.: 16/706,220

(22) Filed: Dec. 6, 2019

(65) Prior Publication Data

US 2021/0003311 A1 Jan. 7, 2021

Related U.S. Application Data

(60) Provisional application No. 62/870,635, filed on Jul. 3, 2019.

(51) Int. Cl.
*F24F 13/02* (2006.01)
*F24F 1/52* (2011.01)

(52) U.S. Cl.
CPC ..... *F24F 13/0245* (2013.01); *F24F 1/52* (2013.01); *F24F 13/0272* (2013.01); *F24F 2221/36* (2013.01)

(58) Field of Classification Search
CPC ..... F24F 13/0245; F24F 13/0272; F24F 1/52; F24F 2221/36; F24F 13/16; F24F 1/028; F24F 12/006
See application file for complete search history.

(56) References Cited

U.S. PATENT DOCUMENTS 3,672,349 A * 6/1972 Derringer ..... F24C 1/06 126/110 AA
2008/0250800 A1* 10/2008 Wetzel ..... F24F 12/006 62/179

FOREIGN PATENT DOCUMENTS

SE 534172 C2 * 5/2011 ..... E04B 1/7076

* cited by examiner

*Primary Examiner* — Frantz F Jules
*Assistant Examiner* — Martha Tadesse
(74) *Attorney, Agent, or Firm* — Johnston IP Law, PLLC

(57) ABSTRACT

A heating ventilating and cooling (HVAC) system includes an outdoor air chase having a first end and a second end. The second end of the outdoor air chase is fluidly coupled to a condenser compartment at a location to receive outside air from the condenser compartment and the first end is fluidly coupled to the return air compartment. The outdoor air chase has a conduit through the outdoor air chase. The system includes a configurable flow regulating plate disposed in the outdoor air chase member across the conduit or otherwise across the outdoor airflow that has a plurality of discharge apertures. Initially, the plurality of discharge apertures is covered by a plurality of knockout panels. Each panel is removably secured to the plate. In installation, the installer removes as many of the knockout panels as required for a desired flow of outdoor air. Other systems and methods are presented.

21 Claims, 11 Drawing Sheets

OUTDOOR AIR CONTROLS FOR PACKAGED HVAC SYSTEMS

CROSS-REFERENCE TO RELATED APPLICATION

This application claims the benefit of U.S. Provisional Application Ser. No. 62/870,635, filed by Wenyen Huang, et al., on Jul. 3, 2019, entitled "Outdoor Air Control For Packaged HVAC System," which is incorporated herein by reference in its entirety for all purposes.

FIELD

This application is directed, in general, to heating, ventilation, and cooling (HVAC) systems, and more specifically, to outdoor air controls for packaged HVAC systems.

BACKGROUND

Heating ventilating and cooling (HVAC) systems come in many sizes and shapes. Some HVAC systems may be installed in a generally vertical format. For example, vertical packaged HVAC systems or packaged terminal air conditioners are self-contained HVAC systems that are commonly used in apartment buildings, high rises, and hotels. The systems are designed to go through a wall, often using a wall sleeve. One example is the MAGIC-PAK® brand system from Allied Air Enterprises LLC. In other situations, a horizontal HVAC system may be used. In any event, while HVAC systems have been used for a long time, improvements are still desired.

SUMMARY

According to an illustrative embodiment, a packaged heating ventilating and cooling (HVAC) system includes a cabinet having a condenser compartment at a bottom portion, a return air compartment at a first portion, and a condenser discharge air compartment between the condenser compartment and the return air compartment. The system further includes a fan panel proximate a bottom of the condenser discharge air compartment and a top of the condenser compartment and an outdoor air chase. The outdoor air chase has a top end and a bottom end. The bottom end of the outdoor air chase is fluidly coupled to the condenser compartment at a location to receive outside air from the condenser compartment. The top end of the outdoor air chase is fluidly coupled to the return air compartment. The outdoor air chase has a conduit through the outdoor air chase.

The system further includes a configurable flow regulating plate disposed in the outdoor air chase member across the conduit. The configurable flow regulating plate includes a plate having a plurality of discharge apertures. In an initial position before installation, the plurality of discharge apertures is covered by a plurality of knockout panels that are removably secured to the plate.

According to an illustrative embodiment, a method of installing a vertical packaged heating ventilating and cooling (HVAC) system includes providing the vertical packaged heating ventilating and cooling (HVAC) system. The system includes a cabinet having a condenser compartment at a bottom portion, a return air compartment at a top portion, and a condenser discharge air compartment between the condenser compartment and the return air compartment.

The method further includes providing an outdoor air chase having a conduit through the outdoor air chase and fluidly coupling the outdoor air chase between the condenser compartment and the return air compartment. The method further includes providing a configurable flow regulating plate. The configurable flow regulating plate includes a plate having a plurality of discharge apertures, and wherein in an initial position before installation the plurality of discharge apertures is covered by a plurality of knockout panels that are removably secured to the plate. The method also includes removing one or more of the plurality of knockout panels and securing the configurable flow regulating plate in the conduit of the outdoor air chase.

According to still another illustrative embodiment, a heating ventilating and cooling (HVAC) system includes a cabinet having a condenser compartment, a return air compartment, and a condenser discharge air compartment between the condenser compartment and the return air compartment, and includes a fan panel proximate the condenser discharge air compartment and the condenser compartment. The HVAC system further includes an outdoor air chase member having a first end and a second end. The second end of the outdoor air chase is fluidly coupled to the condenser compartment at a location to receive outside air from the condenser compartment. The first end of the outdoor air chase is fluidly coupled to the return air compartment, and the outdoor air chase has a conduit through the outdoor air chase. The HVAC system also includes a configurable flow regulating plate disposed in the outdoor air chase member across the conduit. The configurable flow regulating plate includes a plate having a plurality of discharge apertures, and wherein, in an initial position before installation, the plurality of discharge apertures is covered by a plurality of knockout panels. Each knockout panel of the plurality of knockout panels is removably secured to the configurable flow regulating plate. Other systems, methods, and devices are disclosed herein.

BRIEF DESCRIPTION

Illustrative embodiments of the present invention are described in detail below with reference to the attached drawing figures, which are incorporated by reference herein and wherein.

DETAILED DESCRIPTION

The ability to vary the outdoor air introduced in many dwellings is important because many dwellings today are being substantially sealed to maximize efficiency. Outdoor air is introduced to promote healthy living as part of the operation of a packaged heating, ventilation, and air cooling (HVAC) when installed. The illustrative embodiments of the disclosure control the outdoor air delivered to provide the desired amount of outdoor air, balancing with system performance and electrical efficiency. In an illustrated embodiment, a configurable flow regulating plate allows the outdoor air flow to be adjusted inside the primary HVAC unit and may allow for control of the amount of air that infiltrates the space for a given sized HVAC system. This may facilitate introduction of the required outdoor air, e.g., amount required under ASHRAE 62.1/62.2. The configurable flow regulating plate may control the amount of outdoor air from 2% to 15% of rated system air in increments as low as 2%, or even lower in some embodiments. In one illustrative embodiment, a mechanical enclosure that is located inside the HVAC system has physical forms, or knockouts, on one portion that can be removed to provide the desired outdoor airflow into a conditioned space of the dwelling.

The configurable flow regulating plate that allows the outdoor air flow to be adjusted inside the primary HVAC unit may be used on a vertical HVAC system or a horizontal system or another orientation. For illustration purposes, a vertical packaged HVAC system is presented, but those skilled in the art should understand that a horizontal unit or one with another orientation may utilize the configurable flow regulating plate in an analogous manner. Moreover, in some embodiments, a the configurable flow regulating plate is part of an outdoor air chase that extends into numerous compartments, but in some illustrative embodiments, the configurable flow regulating plate may be otherwise mounted to be in the outdoor airflow path in any manner.

Figure 1:
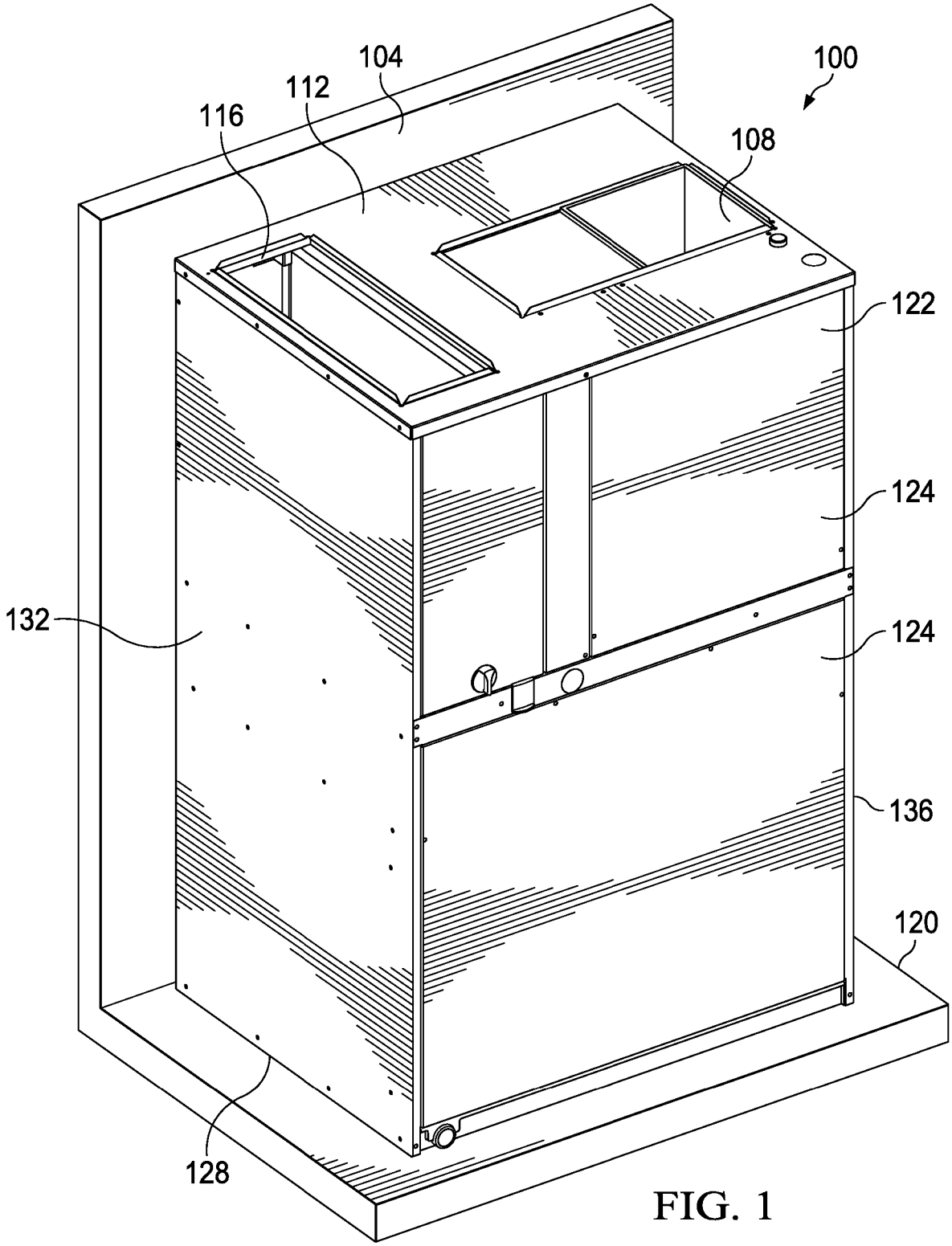
FIG. 1 is a schematic perspective view of the packaged heating, ventilation, and air cooling (HVAC) unit or system according to one illustrative embodiment.

Referring now to the figures and initially and primarily to FIG. 1, a packaged heating, ventilation, and air cooling (HVAC) unit or system 100 is presented according to one illustrative embodiment. The packaged HVAC unit 100, however, includes an outdoor air chase assembly that allows for outdoor air to be introduced at varying flow rates as desired.

The packaged HVAC unit 100 is mounted against an exterior wall 104 through which the packaged HVAC unit 100 gains access to outside air. A supply duct opening 108 is visible from a top portion 112. As used herein the terms "top," "side," and "bottom" are for the orientations shown in the figures and are not necessarily meant to be limited to gravitation orientation. A return duct opening 116 is also on the top portion 112. The unit 100 rests on a floor or support 120. The packaged HVAC unit 100 may be used in apartments, high rises, or other locations. An exterior cut (not explicitly shown) is made in the exterior wall 104 to allow access to the outdoor air by a wall sleeve (not shown).

The packaged HVAC unit 100 may be formed with a cabinet 122 having one or more front panels 124. For the orientation shown, the packaged HVAC unit 100 has the top portion 112, a bottom portion 128, a first side 132, and a second side 136.

In some installations, depending on the applicable code or user desires or requirements, a certain amount of outdoor air is introduced through the packaged HVAC unit 100 into the conditioned space of the residential or commercial unit that the HVAC unit 100 serves. As building envelopes get tighter, bringing air inside from the outside in a controlled manner is increasingly important. The outdoor air introduced is mixed with the recirculating air from the conditioned space and returned again to the living space, or conditioned space. The embodiments herein may allow adjustment of the airflow from the outside in an efficient manner and provide for easy installation. The outside air is introduced through an outdoor air chase (see e.g., 200 in FIG. 2) into the blower compartment, or return air compartment (see 228 in FIG. 2). In one embodiment, a configurable flow regulating plate (see, e.g., 300 in FIG. 5) covers the top of an outdoor air chase and can readily have different panels (knockouts panels or punches or forms) removed to expose openings and thereby adjust the airflow rate through the configurable flow regulating plate. For each packaged unit or system, a correlation may be done so that each knockout panel removed will give a certain airflow rate (see, e.g., Table A further below).

Figure 2:
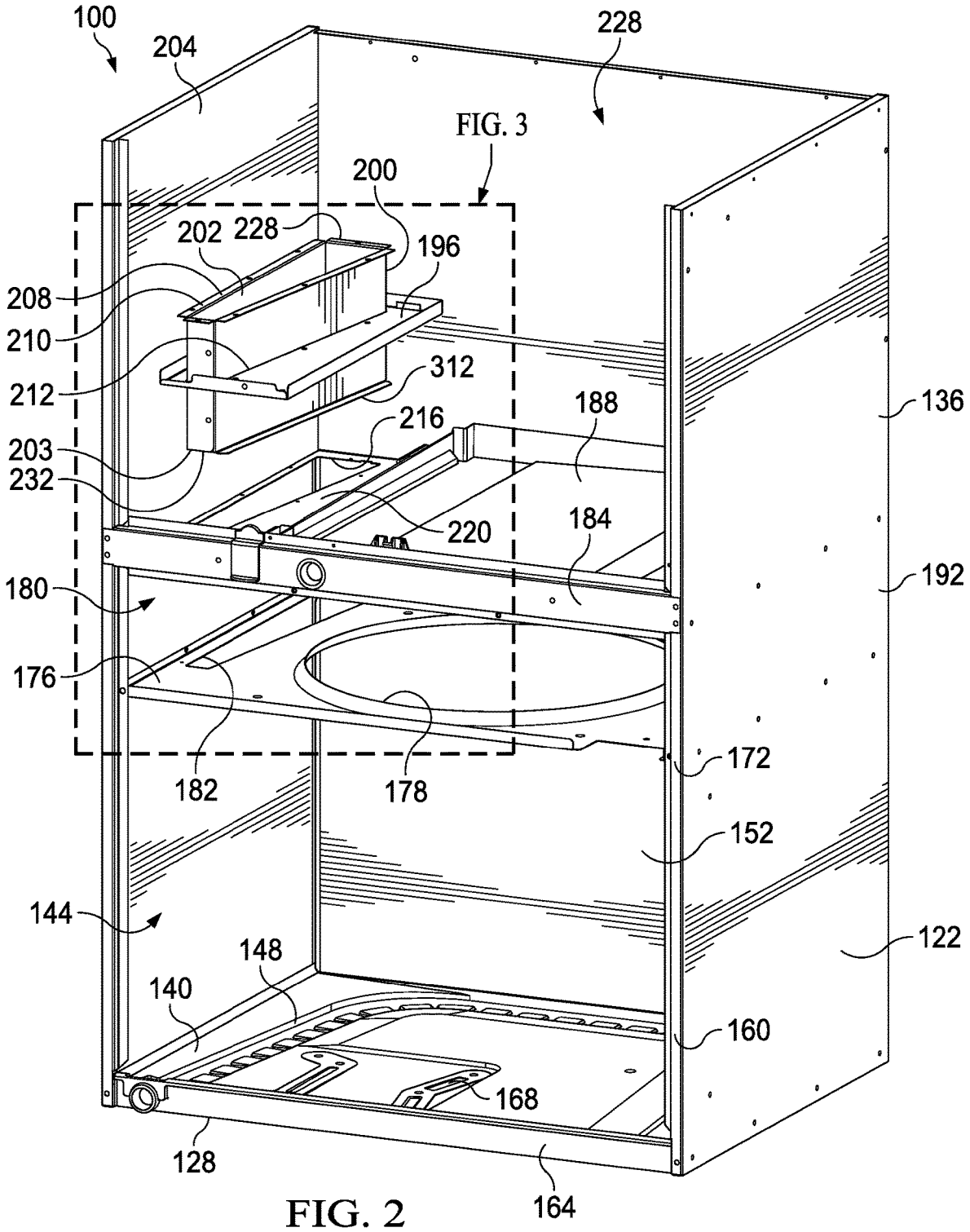
FIG. 2 is a schematic, front perspective view of the packaged HVAC unit of FIG. 1 with the front and top panels and various internal components removed for illustrative purposes to show an illustrative embodiment of an outdoor air chase.

Referring now primarily to FIG. 2, the packaged HVAC unit 100 with the plurality of front panels 124 removed is shown. The packaged HVAC unit 100 has, at the bottom portion 128, a unit base 140, which is a bottom of a condenser compartment 144. The unit base 140 may be formed from a plastic base or metal or other material that is at least semi-rigid. The unit base 140 forms the bottom of the condenser compartment 144. A condenser coil (not shown but well known) is, in the assembled position, in the condenser compartment 144, but has been removed from the figure for clarity. The track 148 where the condenser coil would mount in this illustrative embodiment is shown.

The condenser coil is typically horseshoe-shaped and mounted on or at the track 148. For clarity, the back area 152 is the portion that has a back opening (not explicitly shown) and is open to the outside. The back area 152 is completely open or may be a solid panel with a partial opening. The opening in the back area 152 is typically covered by a louver (not explicitly shown). A unit frame 160 is visible in this view and has a front portion 164. A compressor (not shown) is typically mounted on a mount 168. At a middle portion 172 (within 25% of being equidistant between the top portion 112 and the bottom portion 128) is a shelf 176, or fan panel, where the condenser fan (not explicitly shown but well known) is attached. The fan panel 176 has a fan aperture 178 and a chase opening 182, or aperture.

The condenser fan draws air from under the fan panel 176 through the outdoor coil of the condenser and discharges the air above the fan panel 176 from where the air is directed to the outside. A portion of the air in the condenser compartment 144 may be pulled to supply outside air into the conditioned space as may be desired to meet regulatory requirements as previously mentioned. A fan discharge compartment or area, or middle section 180, just above the fan panel 176 is where air coming off the condenser coil is received and is forced outside after having helped cool the condenser.

A support brace 184 forms part of the frame 160 and helps tie the unit 100 together. A drain pan 188 is positioned proximate the support brace 184 and, in a fully assembled position, is under the evaporator (not explicitly shown, but well known). In this view, a side panel 192 on second side 136 is visible. A tray 196 is coupled on a left portion (for the orientation shown) on or proximate a shelf 220 (or member or intermediate floor) and allows the manufacturer to assemble and mount an outdoor air chase 200 to a left panel 204 on the first side 132 (FIG. 1) and back panel 152. FIG. 2 is an exploded view with respect to the location of the tray 196 and the outdoor air chase 200. The tray 196 also provides a place for an optional damper assembly (see FIGS. 7 and 8) to be attached and other possible accessories.

The packaged HVAC unit 100 is formed with the cabinet 122. The cabinet 122 forms at least three compartments: the condenser compartment 144, condenser discharge air compartment 180, and the return air compartment 228.

The outdoor air chase 200 may be formed with a first aperture 202 at a top and a second aperture 203 at a bottom of the outdoor air chase 200. The outdoor air chase 200 may have a folded over flange 208. The outdoor air chase 200 is positioned in an aperture 212 through the tray 196. The flange 208 formed a top 210 of the chase 200 may facilitate placement of the air chase 200 and provide a location for securing other members. A portion of the outdoor air chase 200 extends through an aperture 216 through in the member or shelf 220, which is coupled with or proximate the drain pan 188. The first end, or top, 210 of the outdoor air chase 200 communicates with a return air compartment 228 where there is reduced pressure (less than ambient or prevailing static pressure). The second end, or bottom, 232 of the outdoor air chase 200 extends through the fan panel 176 and into the condenser compartment 144 or is otherwise fluidly coupled to the condenser compartment 144. To be clear, FIG. 2 is an exploded view with respect to the outdoor air chase's 200 position.

Figure 3:
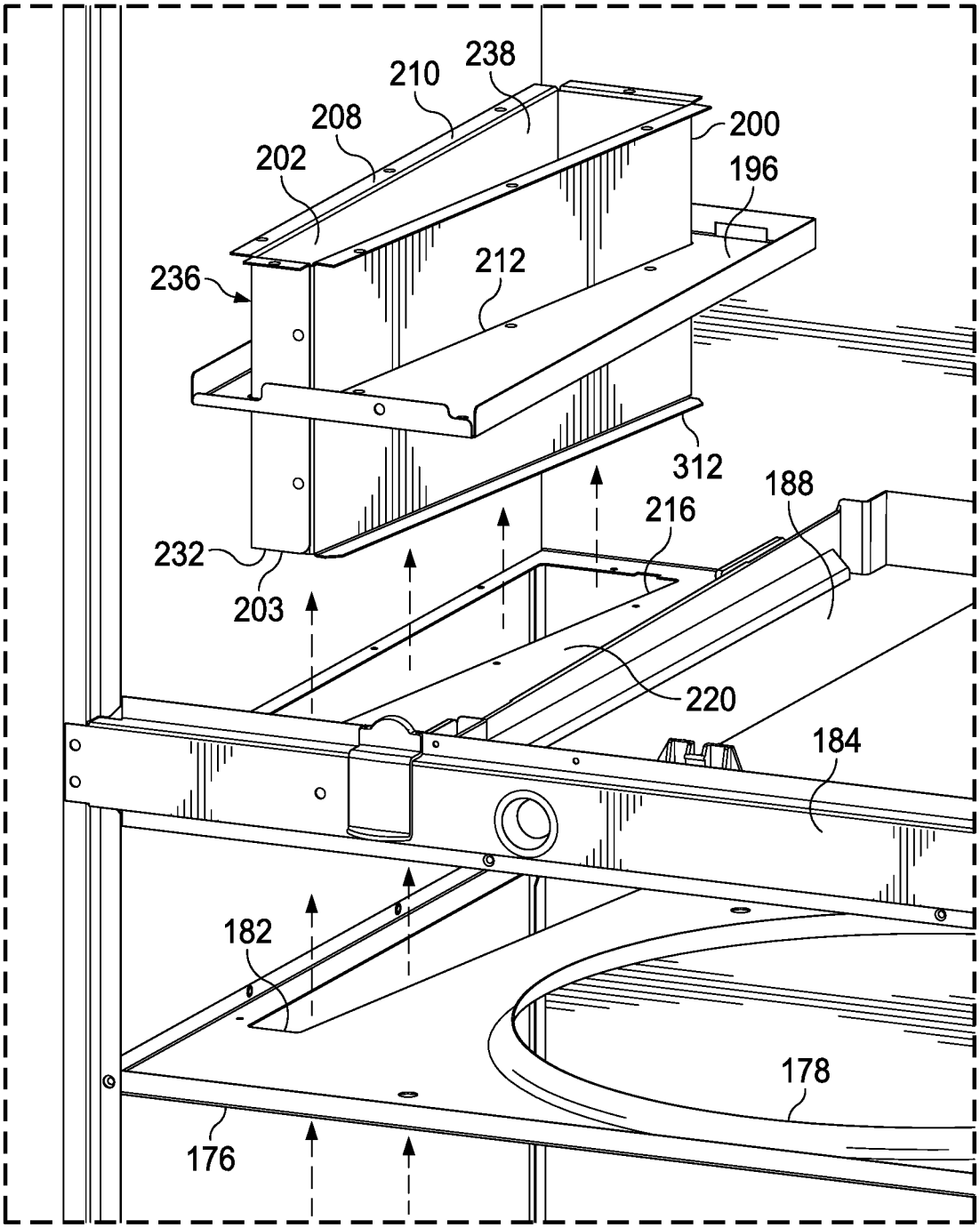
FIG. 3 is a detail of a portion of FIG. 2.

Referring now primarily to FIG. 3, which is a detail from FIG. 2, the tray 196 is fastened to the member 220, or intermediate floor, when in the assembled position. The outdoor air chase 200 may be secured in the aperture 212 in the manufacturing process with tabs and fasteners, welds, adhesives, or other attachment techniques. The combined outdoor air chase 200 and the tray 196 form an assembly 236. That assembly 236 is installed in the member or floor 220. In the assembled position, a portion of the outdoor air chase 200 extends down to the aperture 182 of the fan panel 176 or is otherwise fluidly coupled to the condenser compartment 144. A gasket 304 (FIG. 9) is disposed proximate the bottom end, or second end 232 of the outdoor air chase 200, and a bug mesh 316 (FIG. 9) covers the bottom end, or second end 232, of the outdoor air chase 200. The outdoor air chase 200 has a conduit 238 through the outdoor air chase 200 that allows air to flow through the outdoor air chase 200.

Figure 4:
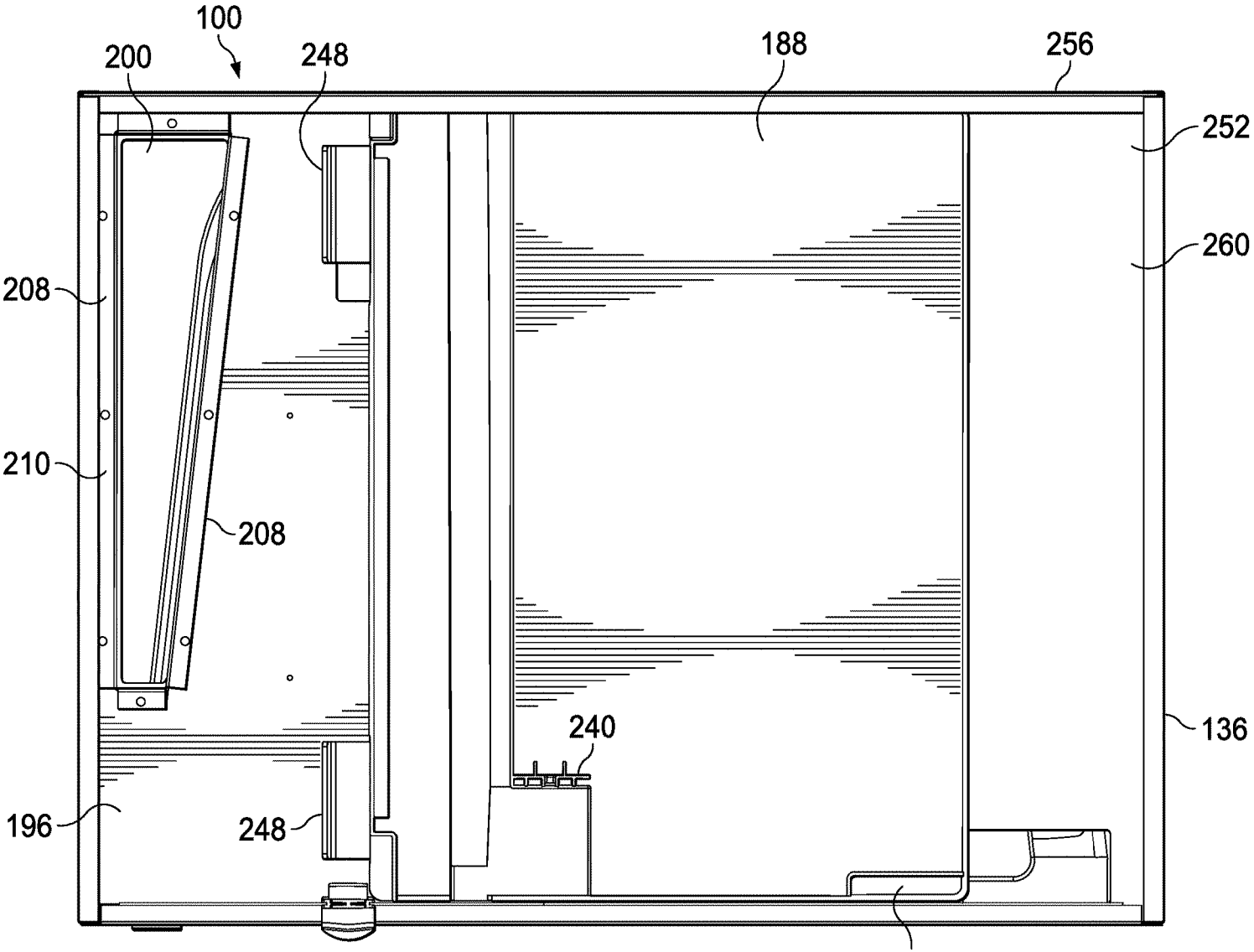
FIG. 4 is a schematic plan view (top) of the packaged unit of FIG. 1 with the top panel(s) removed according to one illustrative embodiment.

Referring now primarily to FIG. 4, a top view of the HVAC packaged unit 100 is shown with the top panel(s) and certain components, e.g., evaporator, removed for clarity. The drain pain 188 under the evaporator is shown. In this view, a feature 240 that allows one to snap in an overflow drain switch is visible. If the field drain gets clogged, the overflow drain switch mounted to feature 240 turns off the unit 100. If water overflows, the water will exit through water overflow channel 244, which allows the water to spill over. Filter guides 248, or rails, are visible. The filter guides 248 direct the indoor air filter as it slides into position. An L-shaped panel, or division panel, 252, which has portions 256 and 260, is shown towards the second side 136. The bottom and back of the return air compartment 228 (FIG. 2) are formed by the L-shaped panel 252. The L-shaped panel 252 is shown more clearly in FIG. 9.

The outdoor air chase 200 is angled as seen from above (plan view) in order to accommodate the horseshoe-shape of the outdoor condenser coil (not explicitly shown, but see track 148 in FIG. 2). The angled shape, or wedge shape, of the outdoor air chase 200 uses more space on one end to provide a bigger opening than would otherwise exist. The angle goes from a wider portion proximate the back panel to a narrow portion near the front portion, and the outside air chase 200 may reduce in size by between 40 and 60 percent. In some embodiments, the packaged unit 100 draws air into the outdoor air chase 200 without that air going through the condenser coil; in that way, the air going to the outdoor air chase 200 is not heated by the condenser coil.

The flange 208 on the top 210 of the outdoor air chase 200 provides support and a sealing surface to seal against the tray 196. There can be a gasket (see 364 in FIG. 9) over the flange 208; the gasket is over the flange 208 and the surface of the shelf 176 or tray 196. The L-shaped panel 252 may have insulation on it—fiberglass insulation that acts as a gasket. There may also be a cover (see, e.g., 328 in FIGS. 12 and 408 in FIG. 13) over the top 210 of the outdoor air chase 200 and a gasket to seal the outdoor air chase.

Figure 5:
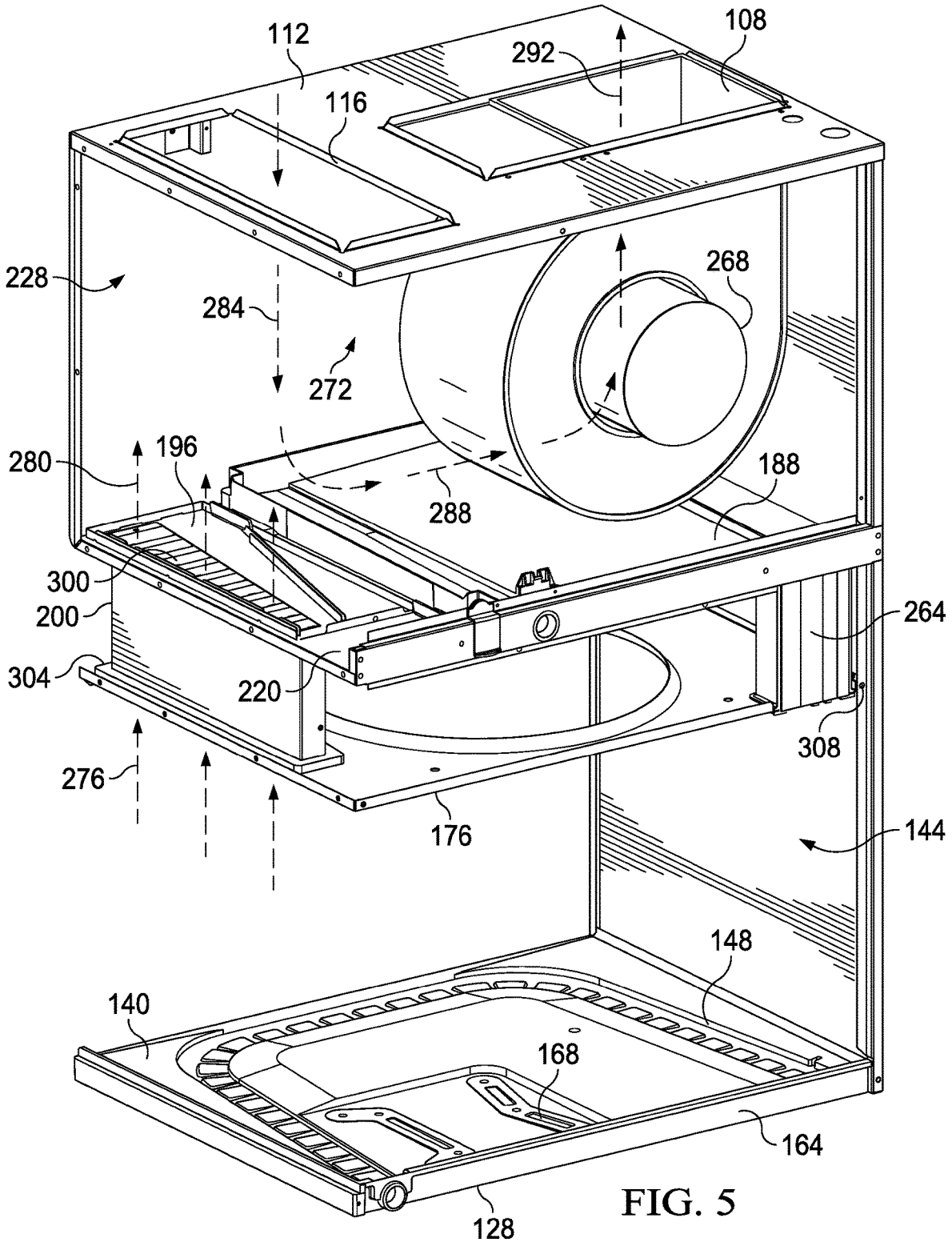
FIG. 5 is a front, schematic perspective view of the packaged unit of FIG. 1 with front and side panels removed along with some of the internal components and showing air flow patterns according to one illustrative embodiment.

Referring now primarily to FIG. 5, a perspective view of an illustrative embodiment of the packaged HVAC system 100 with the left side and on or more panels (124 in FIG. 1) removed and certain components, e.g., evaporator and condenser, removed for clarity is presented. The system 100 is shown with the outdoor air chase 200 in the assembled position with those components removed. The condenser coil compartment 144 is shown at the bottom. The fan discharge area or middle section 180 is shown. An insulated wire chase 264 is visible, and the return air compartment (or evaporator compartment) 228 at the top is visible. An indoor blower assembly 268 is shown in the return air compartment 228. Evaporator coils (not shown) would be approximately where 272 is shown; the evaporator sits vertically on the drain pan 188 in some embodiments. Heating elements are not visible but are mounted near the discharge of the indoor blower assembly 268.

The figure presents a number of airflow patterns of the HVAC unit 100. Outdoor air 276 goes through an opening in the exterior wall and then is pulled upward (for orientation shown). A portion of the outdoor air 276 goes into outdoor air chase 200 and then goes as chase air 280 into the lower pressure air in the return air compartment 228 and mixes with re-circulated air or return air 284 from the conditioned space. The return air 284 is pulled through a return duct or aperture 116. The mixed air 288 is then moved by the indoor air blower assembly 268 across the evaporator coil or heaters and then out through a supply duct or aperture 108 as conditioned air 292.

A configurable flow regulating plate 300 is disposed over the outdoor air chase 200 proximate the top 210 and regulates the flow of air through the outdoor air chase 200. The configurable flow regulating plate 300 will be explained in more detail further below.

At the bottom or second end 232 of the outdoor air chase 200 is a gasket 304 that seals between the bottom 232 of the outdoor air chase 200 around the second aperture 203 and the fan panel 176, or shelf. In one embodiment, a handful of fasteners 308, e.g., screws, tabs, or other fasteners, are used to attach the fan panel 176. Optional flanges 312 (FIG. 3) of the air chase 200 are over the gasket 304 in some embodiments and under the gasket 304 in other embodiments. The gasket 304 prevents air leakage that might occur from laser etching or any other slits. The gasket 304 also prevents air and water from leaking into the fan discharge area 180, or compartment.

Figure 6:
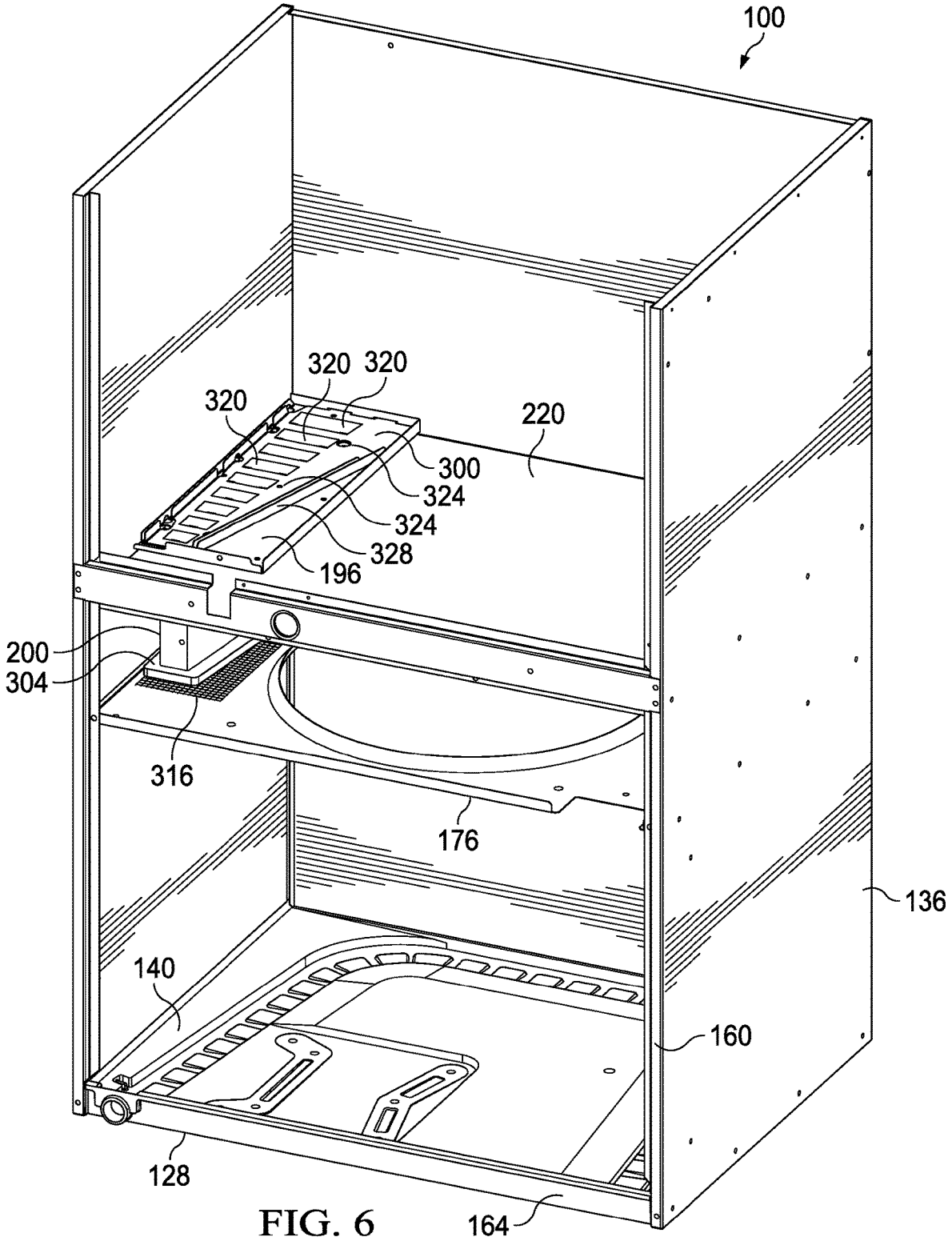
FIG. 6 is a front, schematic perspective view with some panels and internal components removed to show the outdoor air chase according to one illustrative embodiment.

As shown in FIG. 6, a screen, or bug mesh 316 may go under the gasket or under the flange 312 and cover aperture 182 (FIG. 3) or the second aperture 203 to keep bugs and particulate out of the airflow that enters the outdoor air chase 200. The gasket 304 seals unwanted outdoor air from leaking through. The bug mesh 316 helps to avoid insect infestation or other debris that might otherwise enter.

Continuing to refer primarily to FIG. 6, the packaged HVAC unit 100 is shown with the front and top panels removed and with various internal components removed for clarity. The gasket 304 and screen, or bug mesh 316 are shown clearly in this view. In this embodiment, the tray 196 on the shelf 220 is shown as a rectangular tray but other shapes might be used. The outdoor air chase 200 goes through the shelf 220 and the tray 196 with the chase's flanges 208 against a top of the tray 196. The gasket 304 goes over the bottom 232 of the outdoor air chase 200 and is coupled with an adhesive backing, fastener, or other technique. The gasket 304 helps form a seal between the outdoor air chase 200 and the fan panel 176.

The outdoor air chase 200 is held against the gasket 304 based on the sizing of the air chase 200 from the top; that is the outdoor air chase 200 is sized and configured to press down on the gasket 304 in the assembled positioned. If someone needs to service the outdoor air chase 200, one can pull the air chase 200 out from the top. Again, item 316 is a debris screen, or mesh, or bug screen.

Figure 12:
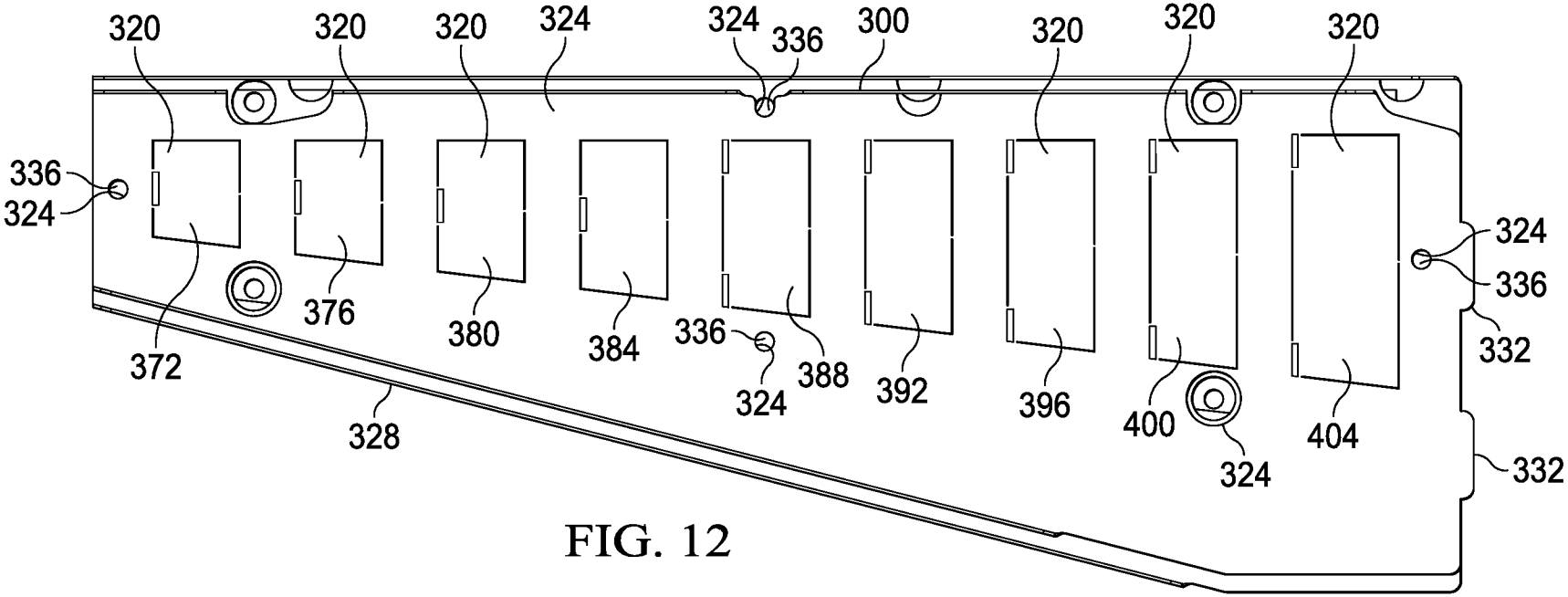
FIG. 12 is a schematic plan view of an illustrative embodiment of a configurable flow regulating plate for use with an outdoor air chase according to an illustrative embodiment.

Referring primarily to FIGS. 6 and 12, the configurable flow regulating plate 300, or knockout lid, helps regulate the airflow through the outdoor air chase 200. The configurable flow regulating plate 300 includes a plurality of punch-out members 320, or knockout panels/members, that may be selectively removed to vary the air flow through the configurable flow regulating plate 300. Thus, for minimal flow, one knockout panel 320 is removed, and for maximum flow all the knockout panels 320 are removed. In manufacturing, starting with a plate that is used to form the configurable flow regulating plate 300, the knockout members 320 can be cut with a laser, punch, angle grinder, saw, or other cutting device except for one or more tabs on each holding the knockout panel in place but allowing the panel to be readily removed by an installer. For example, in one illustrative embodiment, 95% of a rectangle is cut, but 5% is left as a tab. The tabs hold the knockout member 320 over what would otherwise be an open airflow aperture in the configurable flow regulating plate 300. The tabs can be released, or "popped" or knocked free, with a screwdriver or other hand tool to open up a selected number of airflow apertures through the configurable flow regulating plate 300. Again, the number of opened apertures determines the flow rate (see, e.g., Table A below).

The configurable flow regulating plate 300 is formed with a plurality of fastener apertures 324 for fasteners, e.g., screws, to go through. In some embodiments, the configurable flow regulating plate 300 is mounted on top of a cover plate 328, which is typically solid. The configurable flow regulating plate 300 may have flanges that are angled up from other portions of the flow regulating plate 300. The cover plate 328 has flanges that are angled up from the other portions of the cover plate 328. A plurality of end tabs 332 may be formed on one end of the configurable flow regulating plate 300 that mate with slots 334 (FIG. 7) on the tray 196, or back panel, to hold the configurable flow regulating plate 300 in place with respect to the cabinet 122; the tabs 332 are used in the assembly process and later fasteners may be used at more locations to secure the configurable flow regulating plate 300 in place relative to the cabinet 122. The fastener apertures 324 may be the same or different sizes for different sized fasteners. When repairing in the field and the flow regulating plate 300 needs to be removed, one does not have to remove all the fasteners with this illustrative embodiment. One can just take fasteners out of the four smaller apertures. The rest of the fasteners would hold the remaining portion of the assembly of the air chase 200 together. When repairing in the field and the outdoor air chase needs to be removed, one would have to remove all the fasteners.

Figure 7:
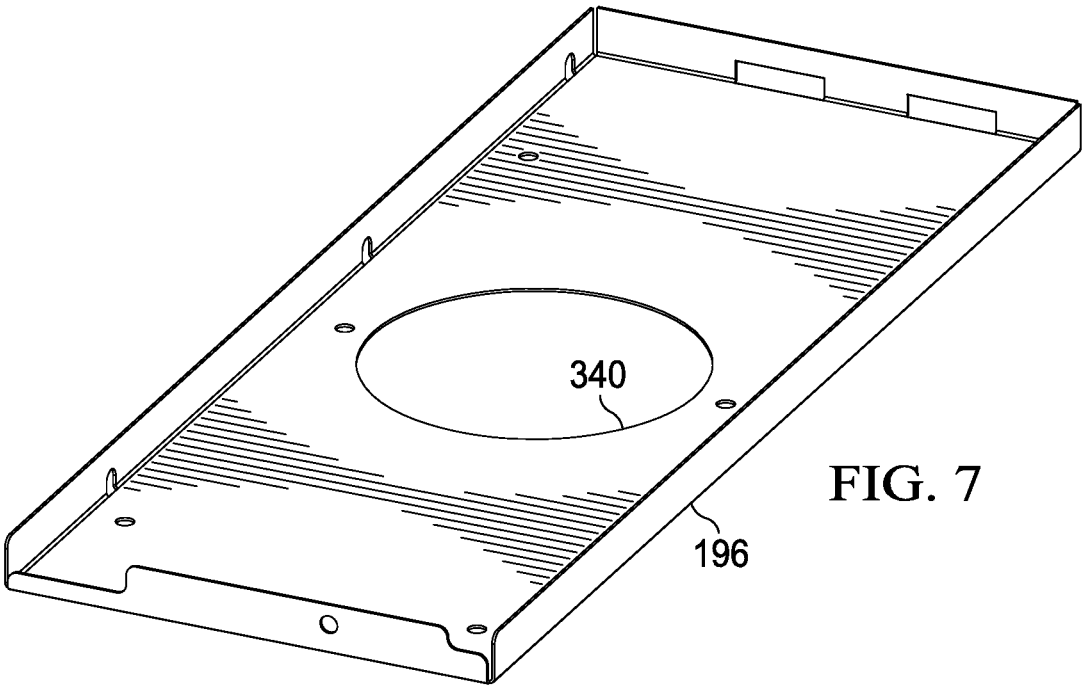
FIG. 7 is a schematic perspective view of a damper adapter that goes over a portion of the outdoor air chase according to one illustrative embodiment.
Figure 8:
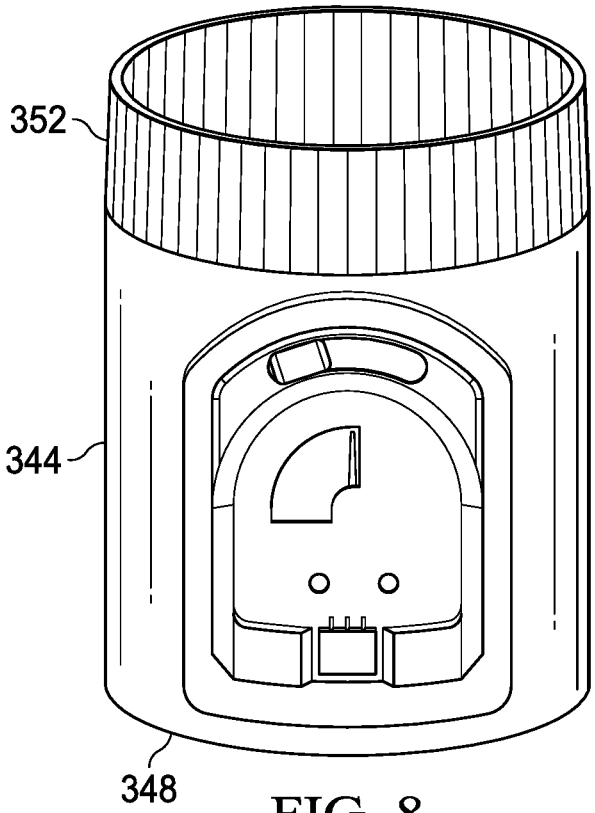
FIG. 8 is an illustrative damper that goes into the aperture on the damper of FIG. 7 according to one illustrative embodiment.

Referring now primarily to FIGS. 7 and 8, an alternative embodiment is presented of the flow regulation scheme. In this illustrative embodiment, the arrangement is the same as that presented in FIG. 6, except the tray 196 in FIG. 7 is formed with a dampener aperture 340 through the tray 196 that is sized and configured to receive a controllable damper 344 (FIG. 8). In some jurisdictions, the authorities want the outdoor air opening to only be open when the blower is on. The authorities require a mechanical damper to do that. The tray 196 covers the top of the outdoor air chase 200 and requires the airflow to go through the dampener aperture 340. The dampener aperture 340 is then controlled as desired by the controllable damper 344. FIG. 8 shows an embodiment as a round damper, but other shapes may be used as well as one skilled in the art would appreciate.

The controllable damper 344 may be associated with a controller that can open and close the damper 344. For example, the controller may make the controllable damper 344 open only when the blower is active. The damper aperture 340 and the damper 344 could take other shapes and sizes as one skilled in the art would appreciate. One example of the controllable damper 344 is Honeywell ARD5TZ. In one embodiment, the controllable damper 344 is binary (open or closed) and relies on a configurable flow regulating plate 300 (FIG. 6) to adjust the flow rate. In still another illustrative embodiment, the controllable dampener 344 can assume a plurality of positions that control the flow rate through it.

The controllable damper 344 has a first end 348 and a second end 352. When assembled, the second end 352 is inserted into the dampener aperture 340. The controllable dampener 344 has a gate or valve that controls the flow through it. Again, the controllable dampener 344 may be binary (on or off) or may have intermediate settings to control the flow rate.

Figure 9:
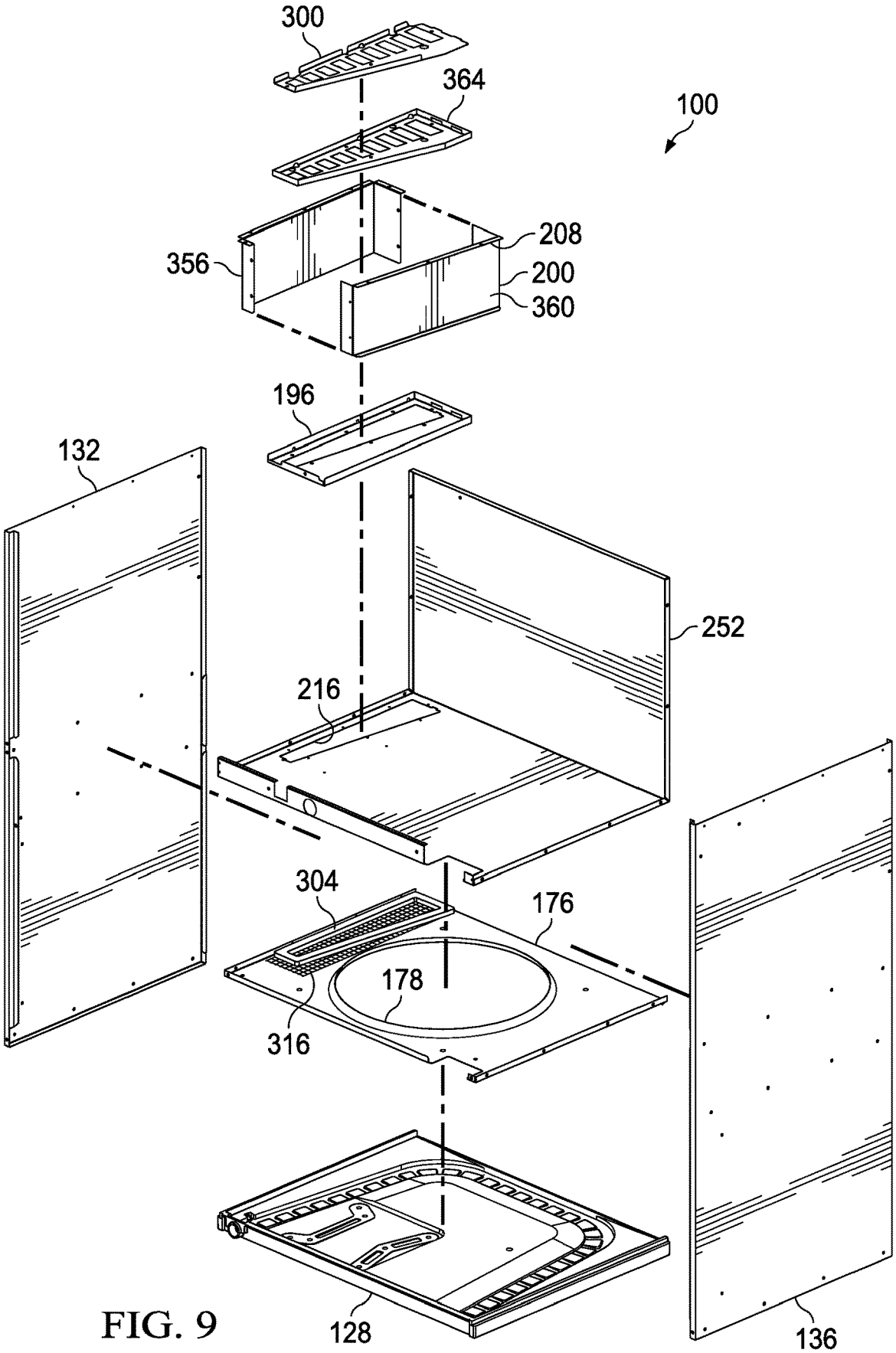
FIG. 9 is an exploded, schematic perspective view of a packaged HVAC unit with the front and top panels removed and various components removed to show the outdoor air chase and associated components according to one illustrative embodiment.
Figure 10:
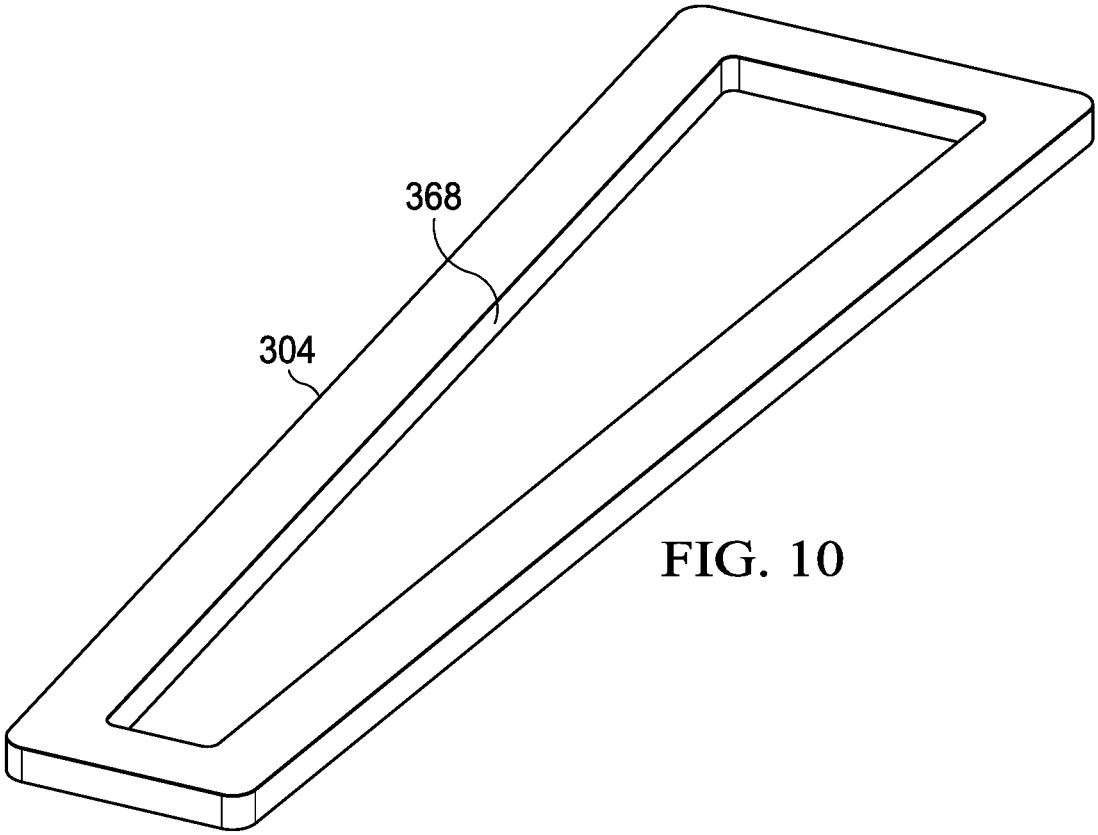
FIG. 10 is an illustrative schematic perspective view of a gasket that may be used at a second end of an outdoor air chase according to one illustrative embodiment.

Referring now primarily to FIG. 9, a schematic, exploded, perspective view of a portion of the packaged HVAC unit 100 is presented according to one illustrative embodiment. The outdoor air chase 200 is shown in two parts, 356, 360. In this view, one may see a top gasket, or first gasket 364, that goes between the top 210 of the outdoor air chase 200 and the configurable flow regulating plate 300. The flange 208 receives the top gasket 364, and the configurable flow regulating plate 300 is fastened to the flange 208. The bottom gasket, or second gasket 304, which is shown in FIG. 10, is supported by the fan panel 176, or shelf. The second gasket 304 is formed with aperture or opening 368 (FIG. 10) to allow for airflow into the outdoor air chase 200. The gaskets 364 and 304 may be water proof and may be formed from rubber, plastic, or any suitable gasket material. The gasket 304 is on top of the fan panel 176 and the fasteners hold the second gasket 304 in place while the outdoor air chase 200 is applied. The gasket 304 and bug mesh 316 are ultimately held secure in one illustrative embodiment by being sandwiched between the bottom 232 of the outdoor air chase 200 and the fan panel 176.

Figure 11:
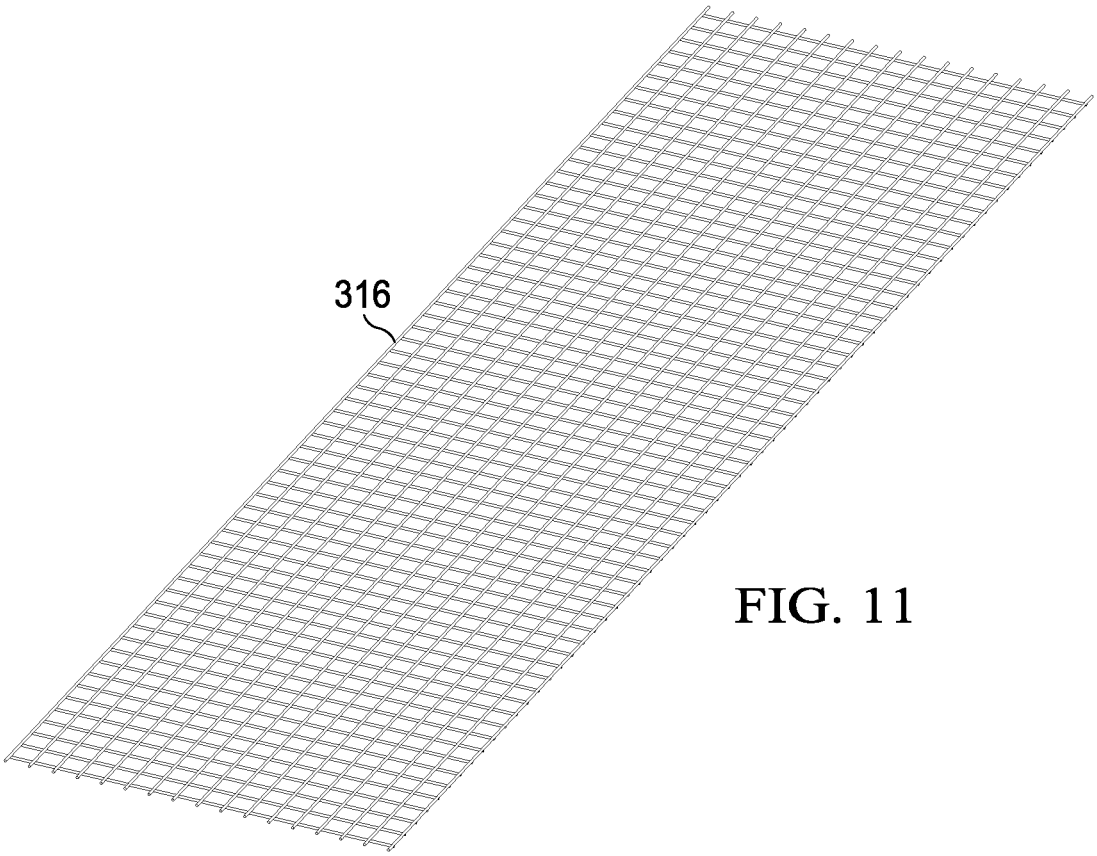
FIG. 11 is a schematic perspective view of a screen, or bug mesh, to go over the outer opening of an outdoor air chase according to one illustrative embodiment.

The screen, or bug mesh 316, which is shown in FIG. 11, may cover aperture 182 (FIG. 3) formed through the fan panel 176 or aperture 203 in the outdoor air chase 200. The bug screen 316 is typically a metal mesh or plastic grid. Unlike the second gasket 304, the bug mesh 316 is not formed with a central aperture, but an integral unit to cover the entire opening 203 to the outdoor air chase 200. The bug mesh 316 is attached with fasteners, e.g., screws, or by adhesive, spot-welding, or other attachment techniques, to the panel.

Once installed, the outdoor air chase 200 applies pressure on the gasket 304 and the mesh screen 316, and holds it all in place. The gasket 304 has an adhesive to keep the gasket 304 in place during assembly. The gasket 304 goes onto the bug mesh 316.

In one alternative embodiment of an outdoor air chase for use with a packaged HVAC system, which is analogous to system 100 in many respects, an outdoor chase is formed from a styrofoam or plastic. The chase may be shaped like a rectangular member with an open bottom and lid that allows for variable flow. The lid may take various positions that each lead to different airflows through the outdoor air chase.

The systems herein allow outdoor air to be introduced and provide an easy way to regulate the amount coming into the re-circulated air.

Referring again primarily to FIG. 12, the illustrative embodiment of the configurable flow regulating plate 300 is shown in more detail in plan view. The configurable flow regulating plate 300 has the plurality of knock-out members 320, or punch-panels, or knockout panels. The plurality of punch-out members 320 includes knockout panels 372-404 that allow the desired airflow in segments or incrementally. The number of knockout panels removed will vary because the square footage of the conditioned spaces or areas varies from application to application. See the Table A further below for an example correlating knockout panels or punches and the resultant outdoor airflow. Some illustrative systems may be between ¾ to 3 ton units and may use this or other sizes too. Each model may have a chart. Those skilled in the art will appreciate that other sizes may be used.

Still referring primarily to FIG. 12, for each knockout panel, or punch-out members 320, an aperture is cut in the hosting plate. The aperture is cut along the border of the knockout panel 320 except a small tab that holds the particular knockout panel 320 in place until the tab is removed by hand or by a hand tool. The tab is strong enough to keep the knockout panel 320 in place with airflow across at the designed flow rates, but is also weak enough to allow removal by a hand tool.

In one illustrative embodiment, the plurality of discharge apertures (formed by removal of the plurality of knockout panels 320) and plurality of knockout panels 320 are sized such that removal of each knockout panel 320 increases airflow of outdoor air through the outdoor air chase 200 during normal operation by between 1% and 5% of rated system air for the packaged HVAC unit 100.

In an alternative design of an illustrative packaged HVAC unit, the outdoor air chase has the area varied by covers being inserted on a base. In another alternative, the outdoor air chase has a sliding cover on a base to vary the airflow. In still another alternative, the outdoor air chase includes a flow regulating plate that regulates the airflow by using an adjustable iris.

Figure 13:
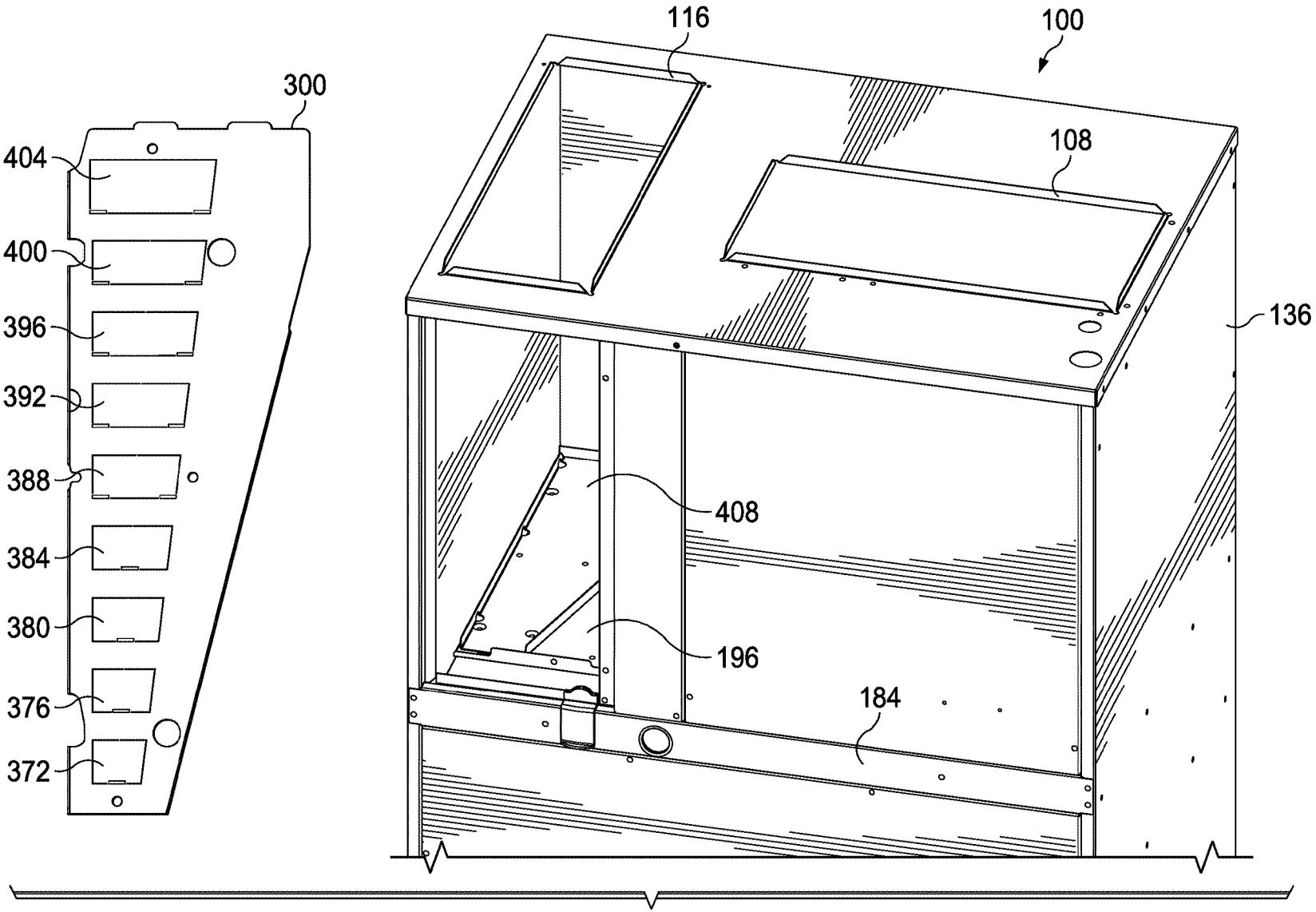
FIG. 13 is a schematic perspective view of an illustrative HVAC packaged unit on the right and also a plan view on the left of a configurable flow regulating plate for use with the HVAC packaged unit.

Referring now primarily to FIG. 13, an in-field sizing approach may be described for a packaged HVAC system 100. FIG. 13 on the right shows an HVAC system 100 with the air chase initially (unassembled position) with a factory panel 408 on the outdoor air chase. With reference to FIG. 13 on the left, one may see that the configurable flow regulating plate 300 has nine knockout panels (covering apertures and that are ready to be knocked out with screw driver or another hand tool), 372, 376, 380, 384, 388, 392, 396 400, and 404. The packaged HVAC unit 100 comes with a factory panel 408 in position and that is replaced with the adjusted configurable flow regulating plate 300 after setting the desired flow rate.

The following table presents empirical-based information for one illustrative embodiment in order for a user to determine how many of the knockout panels to remove.

TABLE A

| | Outdoor Ventilation Air (CFM) | | | | | |
|---|---|---|---|---|---|---|
| | A ¾ Ton | B 1 Ton | C 1½ Ton | D 2 Ton | E 2½ Ton | F 3 Ton |
| Down-Number of discharge apertures opened; Across - Nominal Indoor airflow | 350 | 400 | 650 | 800 | 1000 | 1200 |
| #1 only | 6 | 7 | 14 | 17 | 19 | 23 |
| #1-#2 | 10 | 12 | 21 | 23 | 26 | 30 |
| #1-#3 | 17 | 19 | 25 | 28 | 30 | 34 |
| #1-#4 | 23 | 25 | 31 | 37 | 39 | 45 |
| #1-#5 | 29 | 31 | 40 | 45 | 50 | 56 |
| #1-#6 | 35 | 37 | 48 | 55 | 60 | 68 |
| #1-#7 | 40 | 43 | 56 | 66 | 72 | 81 |
| #1-#8 | 45 | 50 | 68 | 76 | 86 | 96 |
| #1-#9 | 50 | 54 | 80 | 92 | 98 | 110 |

Table A has the number of knockout panels 372-404 (FIG. 13) removed in the left column and airflow rates in cubic feet per minute (CFM) in the main cells of the table. The top row is for the different sized units. A is product MCE4-11-09. B is product MCE4-11-12. C is product MCE4-11-18. D is product MCE4-11-24. E is product MCE4-11-30. F is product MCE4-11-36. The configurable flow regulating plate 300 seals the return air compartment at the outdoor duct or air chase 200 unless one or more knockout panels 372-404 are removed. Yet, the installer/technician may choose to remove as many knockout panels as desired for a desired flow rate of outdoor air. This is only one illustrative example. In some embodiments, the outdoor air can be varied from 2% to 15% of rated system air in increments as low as 2%. Other sizing options are contemplated.

The relationship of air enthalpy and temperature may be used in setting the desired air flow rate. By using calculations from the thermodynamic laws, one may determine the size and quantity of the knockout panels for precise air control: Incoming outdoor airflow=[(incoming air enthalpy−indoor air enthalpy)/(outdoor air enthalpy−indoor air enthalpy)]*incoming airflow.

In some embodiments, the packaged HVAC unit 100 may come with the solid plate 408, or factory panel, and with an optional configurable flow regulating plate 300. In that way, the installer can exercise various options. In one illustrative embodiment, if too many knockouts are removed, one or more knockout apertures can be covered with duct tape or the like to reduce the number of open knockout apertures.

In some illustrative embodiments, an outdoor air mechanism that has a plurality of knockouts is provided. The knockouts cover apertures that allow for outdoor air entry into a conditioned space. With the selective removal of knockouts, the outdoor airflow may be adjusted to allow for precise adjustment of the outdoor airflow into the conditioned space. In another illustrative embodiment, instead of knockouts, the outdoor air mechanism has an automated dampener that may be controlled by a controller to further open or close the dampener and thereby control the airflow through the automated dampener. In another embodiment, a packaged HVAC system is sent from the factory with a solid plate for a set outdoor airflow or no outdoor airflow, and has a separate configurable flow regulating plate that may be easily applied to the outdoor air chase in the field during installment as desired.

In one illustrative embodiment, the a configurable flow regulating plate 300 is applied to the outdoor air chase 200, but in addition, an automated dampener 344 is also applied to the outdoor air chase 200. In this way, the airflow may be set using the knockout panels, but can also be controlled in a binary fashion (on/off, open/closed) so that airflow only occurs when desired. In this way, for example, the airflow may only be allowed when the blower is running.

In one illustrative embodiment the cabinet is 44, 48, 56, or 68 inches tall. In one illustrative embodiment, the outdoor air chase is six inches and in another 10 inches, but those skilled in the art will appreciate that other dimensions may be used.

Again, in some embodiments, the configurable flow regulating plate may be used with a horizontal or other orientation HVAC system. In some illustrative embodiments, the configurable flow regulating plate may be mounted in the outdoor airflow path in any fashion. For example, in one illustrative embodiment, the HVAC system is analogous to the packaged vertical HVAC system shown above, but is configured to be substantially horizontal, i.e., the long dimension is orthogonal to the gravitational field and the outdoor chase be mounted with fasteners and may be shorter than shown above.

Unless otherwise specified, any use of any form of the terms "connect," "engage," "couple," "attach," or any other term describing an interaction between elements is not meant to limit the interaction to direct interaction between the elements and may also include indirect interaction between the elements described. "Coupled" in some instances may refer to fluid coupling. In the discussion herein and in the claims, the terms "including" and "comprising" are used in an open-ended fashion, and thus should be interpreted to mean "including, but not limited to . . . "

It will be understood that the benefits and advantages described above may relate to one embodiment or may relate to several embodiments. It will further be understood that reference to "an" item refers to one or more of those items.

The steps of the methods described herein may be carried out in any suitable order, or simultaneously where appropriate.

In the detailed description of the preferred embodiments herein, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The detailed description herein is, therefore, not to be taken in a limiting sense, and the scope of the present invention is defined only by the claims.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

What is claimed:

1. A packaged heating ventilating and cooling (HVAC) system comprising: a cabinet having a condenser compartment at a bottom portion, a return air compartment at a top portion, and a condenser discharge air compartment between the condenser compartment and the return air compartment; a fan panel proximate a bottom of the condenser discharge air compartment and a top of the condenser compartment; a shelf proximate a bottom of the return air compartment and a top of the condenser discharge air compartment, wherein the fan panel and the shelf partially define the condenser discharge air compartment; an outdoor air chase positioned within the cabinet and extending through the condenser discharge air compartment, the outdoor air chase having a top end and a bottom end, wherein the bottom end of the outdoor air chase is connected to the fan panel and fluidly coupled to the condenser compartment, the outdoor air chase configured to receive outside air by way of the condenser compartment, and wherein the top end of the outdoor air chase is connected to the shelf and fluidly coupled to the return air compartment, and wherein the outdoor air chase has a conduit through the outdoor air chase; a configurable flow regulating plate disposed in the outdoor air chase across the conduit; and wherein the configurable flow regulating plate comprises: a plate having a plurality of discharge apertures, wherein, in an initial position before installation, the plurality of discharge apertures is covered by a plurality of knockout panels, wherein each knockout panel of the plurality of knockout panels is removably secured to the configurable flow regulating plate, and wherein, in an installed position, the plurality of discharge apertures and plurality of knockout panels are sized such that removal of each knockout panel increases airflow of outdoor air through the outdoor air chase during normal operation.

2. The packaged heating ventilating and cooling (HVAC) system of claim 1, wherein the outdoor air chase has a first aperture at the top end, and wherein the configurable flow regulating plate is coupled proximate the first end of the outdoor air chase and covers the first aperture.

3. The packaged heating ventilating and cooling (HVAC) system of claim 1, wherein the plurality of knockout panels is configured for removal by an installer using a hand tool.

4. The packaged heating ventilating and cooling (HVAC) system of claim 1, further comprising an automated dampener coupled to the outdoor air chase.

5. The packaged heating ventilating and cooling (HVAC) system of claim 2, further comprising a gasket disposed between the bottom end of the outdoor air chase and a top surface of the fan panel.

6. The packaged heating ventilating and cooling (HVAC) system of claim 2, further comprising a gasket and a bug mesh disposed between the bottom end of the outdoor air chase and a top surface of the fan panel.

7. The packaged heating ventilating and cooling (HVAC) system of claim 1, wherein the outdoor air chase is formed with a wedge shape when viewed from a top plan view.

8. The packaged heating ventilating and cooling (HVAC) system of claim 1, wherein the top end of the outdoor air chase is formed with a top flange at the top end of the outdoor air chase, and further comprising a first gasket under the top flange and on a support tray.

9. The packaged heating ventilating and cooling (HVAC) system of claim 1, wherein removal of each knockout panel increases airflow of outdoor air through the outdoor air chase during normal operation by between 1% and 15% of rated system air.

10. The packaged heating ventilating and cooling (HVAC) system of claim 1, further comprising:

wherein the outdoor air chase has a first aperture at the top end, and wherein the configurable flow regulating plate is coupled proximate the first end of the outdoor air chase and covers the first aperture;

wherein the plurality of knockout panels is configured for removal by an installer using a hand tool;

a gasket disposed between the bottom end of the outdoor air chase and a top surface of the fan panel;

a bug mesh also disposed between the bottom end of the outdoor air chase and a top surface of the fan panel; and wherein the outdoor air chase is formed with a wedge shape when viewed from a top plan view.

11. The packaged heating ventilating and cooling (HVAC) system of claim 10, wherein the top end of the outdoor air chase is formed with a first flange, and further comprising a first gasket between the first flange and a support tray.

12. The packaged heating ventilating and cooling (HVAC) system of claim 1, wherein the top end of the outdoor air chase is formed with a first flange at the top end of the outdoor air chase; and wherein the bottom end of the outdoor chase is formed with a second flange.

13. The packaged heating ventilating and cooling (HVAC) system of claim 1, wherein the outdoor air chase comprises: a first portion coupled to a second portion, each portion having a top end and a bottom end; wherein the top end of the outdoor air chase is formed with a first flange at the top end of the outdoor air chase; and wherein the bottom end of the outdoor chase is formed with a second flange.

14. A method of installing a vertical packaged heating ventilating and cooling (HVAC) system, the method comprising:

providing the vertical packaged heating ventilating and cooling (HVAC) system, wherein the HVAC system comprises a cabinet having a condenser compartment at a bottom portion, a return air compartment at a top portion, and a condenser discharge air compartment between the condenser compartment and the return air compartment;

providing an outdoor air chase having a conduit through the outdoor air chase;

fluidly coupling the outdoor air chase between the condenser compartment and the return air compartment;

providing a configurable flow regulating plate;

wherein the configurable flow regulating plate comprises:

a plate having a plurality of discharge apertures, and wherein, in an initial position before installation, the plurality of discharge apertures is covered by a plurality of knockout panels, each knockout panel is removably secured to the configurable flow regulating plate;

removing one or more of the plurality of knockout panels, wherein removing one or more of the plurality of knockout panels comprises removing a number of the knockout panels corresponding with a desired flowrate of outside air through the outdoor air chase; and securing the configurable flow regulating plate in the conduit of the outdoor air chase.

15. The method of claim 14, wherein the outdoor air chase has a top end having a first aperture, and wherein securing the configurable flow regulating plate in the conduit of the outdoor air chase comprises attaching the configurable flow regulating plate over the first aperture.

16. The method of claim 14, wherein removing one or more of the plurality of knockout panels comprises removing one or more of the plurality of knockout panels using a hand tool.

17. The method of claim 14, wherein the system further comprises a fan panel proximate a bottom of the condenser discharge air compartment and a top of the condenser compartment and wherein the outdoor air chase has a top end and a bottom end, and further comprising disposing a gasket between the bottom end of the outdoor air chase and a top surface of the fan panel.

18. The method of claim 14, wherein the system further comprises a fan panel proximate a bottom of the condenser discharge air compartment and a top of the condenser compartment and wherein the outdoor air chase has a top end and a bottom end, and further comprising disposing a gasket and a bug mesh between the bottom end of the outdoor air chase and a top surface of the fan panel.

19. A heating ventilating and cooling (HVAC) system comprising: a cabinet having a condenser compartment, a return air compartment, and a condenser discharge air compartment between the condenser compartment and the return air compartment; a fan panel proximate the condenser discharge air compartment and the condenser compartment; an outdoor air chase having a first end and a second end, wherein the second end of the outdoor air chase is fluidly coupled to the condenser compartment at a location to receive outside air from the condenser compartment, and wherein the first end of the outdoor air chase is fluidly coupled to the return air compartment, and wherein the outdoor air chase has a conduit through the outdoor air chase; a configurable flow regulating plate disposed in the outdoor air chase across the conduit; and wherein the configurable flow regulating plate comprises: a plate having a plurality of discharge apertures, wherein, in an initial position before installation, the plurality of discharge apertures is covered by a plurality of knockout panels, wherein each knockout panel of the plurality of knockout panels is removably secured to the configurable flow regulating plate, and wherein, in an installed position, the plurality of discharge apertures and plurality of knockout panels are sized such that removal of each knockout panel increases airflow of outdoor air through the outdoor air chase during normal operation.

20. The heating ventilating and cooling (HVAC) system of claim 19, wherein the cabinet is substantially parallel to a gravitational field.

21. The heating ventilating and cooling (HVAC) system of claim 19, wherein the cabinet is substantially orthogonal to a gravitational field.

* * * * *